US011213764B1

(12) United States Patent
Li

(10) Patent No.: US 11,213,764 B1
(45) Date of Patent: Jan. 4, 2022

(54) KID PLAY TUNNEL AND STORAGE METHOD THEREOF

(71) Applicant: Haiying Liu, Ankang (CN)

(72) Inventor: Jie Li, Xiangyang (CN)

(73) Assignee: Haiying Liu, Ankang (CN)

( * ) Notice: Subject to any disclaimer, the term of this patent is extended or adjusted under 35 U.S.C. 154(b) by 0 days.

(21) Appl. No.: 17/394,440

(22) Filed: Aug. 5, 2021

(30) Foreign Application Priority Data

Nov. 23, 2020 (CN) ..... 202022729565.7

(51) Int. Cl.
*E04H 15/40* (2006.01)
*A63H 33/00* (2006.01)
*A63B 9/00* (2006.01)

(52) U.S. Cl.
CPC ..... *A63H 33/008* (2013.01); *E04H 15/40* (2013.01); *A63B 9/00* (2013.01)

(58) Field of Classification Search
CPC ..... A63B 9/00; A63B 15/40; A63B 17/00; A63H 33/008; E04H 15/40
USPC ..... 472/116; 482/35; 446/227, 486; 135/125–126
See application file for complete search history.

(56) References Cited

U.S. PATENT DOCUMENTS 5,618,246 A * 4/1997 Zheng ..... A63B 9/00 135/126
5,685,076 A * 11/1997 Curley ..... E04H 15/40 135/95
6,267,129 B1 * 7/2001 Zheng ..... E04H 15/40 135/126
6,289,910 B1 * 9/2001 Zheng ..... A63B 9/00 135/125
8,021,272 B2 * 9/2011 Zheng ..... A63B 17/00 482/35
2003/0022761 A1 * 1/2003 Brereton ..... A63B 9/00 482/35

* cited by examiner

*Primary Examiner* — Kien T Nguyen

(57) ABSTRACT

A kid play tunnel comprises an elastic frame, a flexible tube coat, and sliding pipes. The elastic frame is in a spiral shape and comprises head sections and connecting sections connected with the head sections. Each head section of the elastic frame overlaps a respective portion of a corresponding connecting section of the elastic frame to form a frame ring. Each frame ring is closed and comprises a spiral end. The flexible tube coat is arranged on a whole section of the elastic frame. Two ends of the flexible tube coat are annular flexible sleeves. Each annular flexible sleeve is sleeved on a respective frame ring. The sliding pipes limit a circumferential sliding of the head sections with respect to the connecting section of the elastic frame. A diameter of each frame ring is reduced by a corresponding sliding pipe when the kid play tunnel is folded.

9 Claims, 4 Drawing Sheets

KID PLAY TUNNEL AND STORAGE METHOD THEREOF

TECHNICAL FIELD

The present disclosure relates to a technical field of children's toy, and in particular to a kid play tunnel with an adjustable and a storage method of the kid play tunnel.

BACKGROUND

Crawling training is an indispensable part of a growth process of young children. Through crawling, a child's limbs are exercised, and the brain's balance and coordination abilities is further developed. A game tunnel toy is a children's toy developed for infant crawling training. When the game tunnel toy is in use, it is relatively large because it needs to satisfy crawling and passing of children.

Therefore, the game tunnel toy often adopts a foldable structure to facilitate logistics and transportation. The game tunnel toy with a foldable structure usually covers one end of an elastic frame with a protective sleeving pipe. A pipe sleeve is arranged on one side of the protective sleeving pipe. The pipe sleeve is sleeved on a frame ring close to one end of the elastic frame to fix the one end of the elastic frame. A volume of the game tunnel toy is reduced by pressing two ends of the elastic frame against each other.

However, the above-mentioned foldable game tunnel toy is generally able to reduce the volume by compressing the game tunnel toy in a length direction, but is unable to compressed in an outer diameter direction to reduce the volume, and still unable to meet requirements of reducing transportation costs

SUMMARY

In order to solve a problem that conventional game tunnel toy is only able to reduce a volume in a length direction, but is unable to contracted in an outer diameter direction to reduce the volume and reduce transportation costs, the present disclosure provides a kid play tunnel with an adjustable diameter during folding and a storage method thereof. When packaging the kid play tunnel, the kid play tunnel is capable of compressing in a length direction and a radial direction to reduce a volume and reduce transportation costs while does not affect its use function.

The present disclosure provides a kid play tunnel with an adjustable diameter during folding. The kid play tunnel comprises an elastic frame, a flexible tube coat, and sliding pipes. The elastic frame is in a spiral shape. The elastic frame comprises head sections respectively arranged on two ends of the elastic frame and connecting sections connected with the head sections. Each head section of the elastic frame overlaps a respective portion of a corresponding connecting section of the elastic frame to form a frame ring. Each frame ring is closed. Each frame ring comprises a spiral end.

The flexible tube coat is arranged on a whole section of the elastic frame. Two ends of the flexible tube coat are annular flexible sleeves. Each annular flexible sleeve is sleeved on a respective frame ring.

The sliding pipes limit a circumferential sliding of the head sections of the elastic frame with respect to the connecting section of the elastic frame. A diameter of each frame ring is reduced by a corresponding sliding pipe when the kid play tunnel is folded.

Furthermore, the sliding pipes are flexible sliding pipes. Each flexible sliding pipe is arranged between a corresponding frame ring and a corresponding annular flexible sleeve. An inner wall of each flexible sliding pipe defines a sliding path of a corresponding head section of the elastic frame and a corresponding connecting section of the elastic frame when the corresponding head section of the elastic frame and the corresponding connecting section of the elastic frame slide relative to each other.

Furthermore, after folding, the diameter of each frame ring is reduced. An arc length of each flexible sliding pipe is no more than a circumference of each frame ring after folding.

Furthermore, a cross section of the inner cavity of each flexible sliding pipe is no less than a cross section of each frame ring.

Furthermore, two ends of each flexible sliding pipe abut against each other to form a circular ring. A diameter of each circular ring is no more than a diameter of the kid play tunnel after folding.

Furthermore, the elastic frame further comprises a spiral section. A first end of each connecting section of the elastic frame is connected with one end of a corresponding head section of the elastic frame. Two ends of the spiral section of the elastic frame is separately connected with a second end of each connecting section of the elastic frame.

Furthermore, a spirally extending hollow interlayer is arranged on an outer wall of the flexible tube coat. The spirally extending hollow interlayer is sleeved on the spiral section of the elastic frame. The spirally extending hollow interlayer is communicated with the annular flexible sleeves.

Furthermore, the sliding pipes are annular sleeving pipes. A protective sleeving pipe is arranged on one side of each annular sleeving pipe. Each protective sleeving pipe is sleeved on a corresponding head section of the elastic frame. Each connecting section of the elastic frame slides along an inner wall of a corresponding annular sleeving pipe to reduce the diameter of a corresponding frame ring.

Furthermore, the kid play tunnel further comprises a flat storage belt. The flat storage belt is closed. A circumference of the flat storage belt is two times of the diameter of each frame ring after folding The present disclosure further provides a storage method of a kid play tunnel. The storage method comprises steps:

S1: controlling head sections of an elastic frame and connecting sections of the elastic frame to slide along inner walls of sliding pipes in a circumferential direction to reduce a diameter of frame rings to a minimum diameter;

S2: reducing a diameter of a whole section of the elastic frame to a same diameter as a minimum diameter of the frame rings;

S3: fixing the kid play tunnel by a flat storage belt arranged on the elastic frame;

and

S4: putting the kid play tunnel into a packaging bag to complete packaging.

The kid play tunnel comprises the elastic frame, a flexible tube coat, and the sliding pipes. The elastic frame is in a spiral shape. The elastic frame comprises head sections respectively arranged on two ends of the elastic frame and connecting sections connected with the head sections. Each head section of the elastic frame overlaps a respective portion of a corresponding connecting section of the elastic frame to form one frame ring. Each frame ring is closed. Each frame ring comprises a spiral end. The flexible tube coat is arranged on a whole section of the elastic frame. Two ends of the flexible tube coat are annular flexible sleeves.

Each annular flexible sleeve is sleeved on a respective frame ring. The sliding pipes limit a circumferential sliding of the head sections of the elastic frame with respect to the connecting section of the elastic frame. A diameter of each frame ring is reduced by a corresponding sliding pipe when the kid play tunnel is folded. The kid play tunnel further comprises the flat storage belt. The flat storage belt is closed. A circumference of the flat storage belt is two times of the diameter of each frame ring after folding.

The kid play tunnel with an adjustable diameter during storage provided by the present disclosure has a simple structure and is convenient to operate After storage, the volume of the kid play tunnel is greatly reduced, which is convenient for transportation, reduces logistics costs, and thus saves cost.

BRIEF DESCRIPTION OF DRAWINGS

In order to explain the embodiments of the present disclosure or the technical solutions in the prior art clearly, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

In the drawings.

Figure 1:
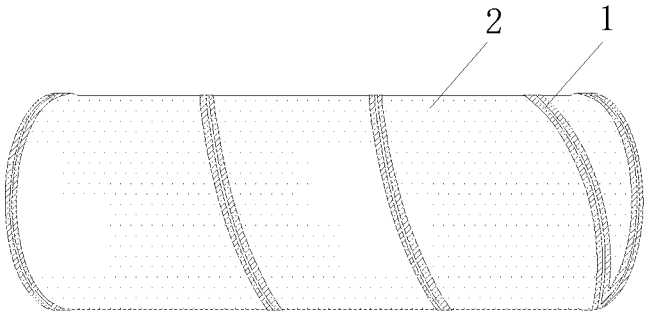
FIG. 1 is a cross-sectional schematic diagram of a kid plat tunnel according to a first embodiment of the present disclosure.
Figure 2:
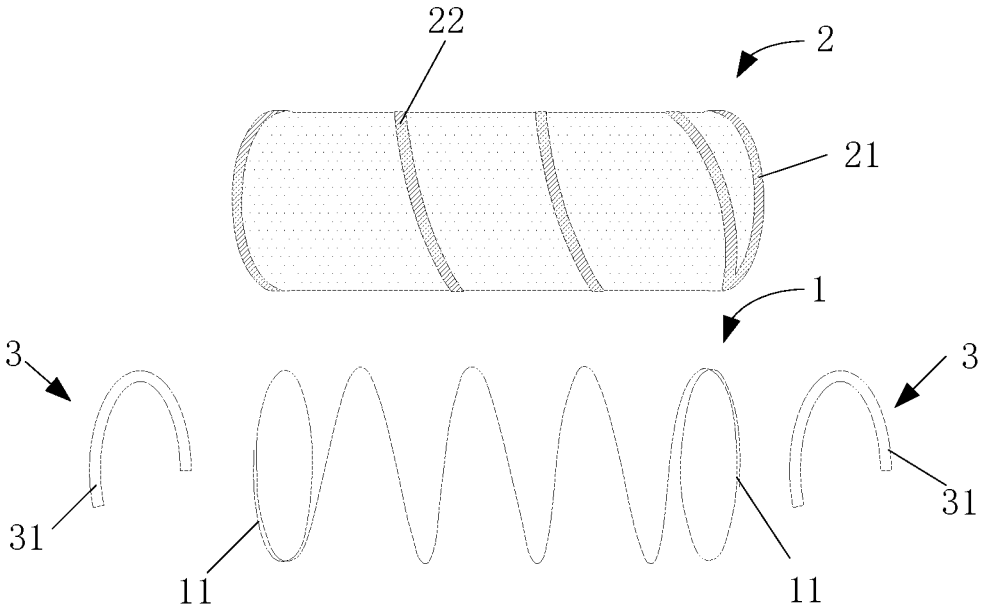
FIG. 2 is an exploded schematic diagram of the kid plat tunnel according to the first embodiment of the present disclosure.
Figure 3:
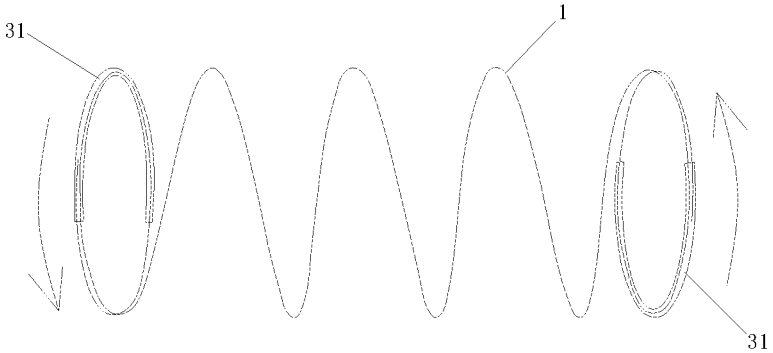
FIG. 3 is a schematic diagram of an elastic frame according to the first embodiment of the present disclosure where the elastic frame is in a state before radial compresses.
Figure 4:
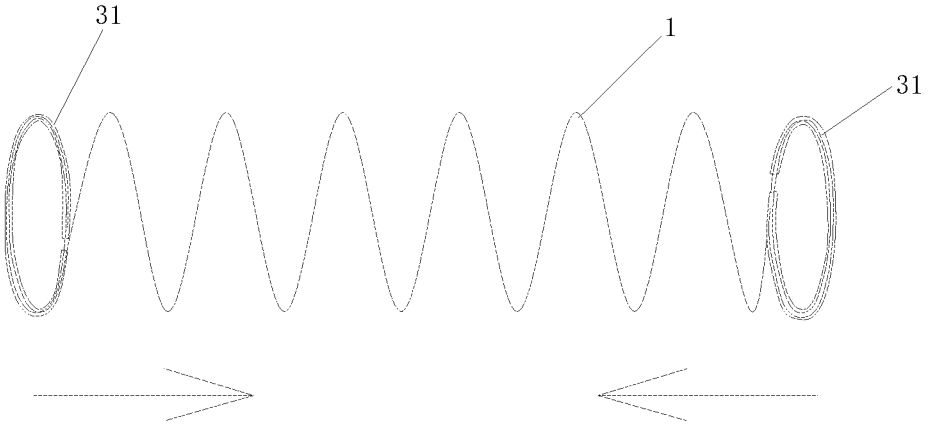
FIG. 4 is a schematic diagram of the elastic frame according to the first embodiment of the present disclosure where the elastic frame is radial compresses.
Figure 5:
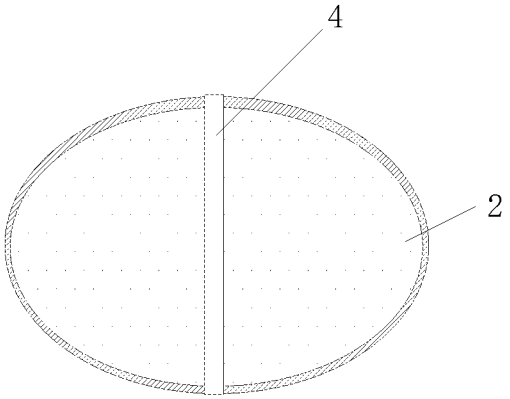
FIG. 5 is a schematic diagram of the kid plat tunnel according to the first embodiment of the present disclosure where the kid play tunnel is in a folded state.

1—elastic frame; 2—flexible tube coat; 3—sliding pipe; 11—frame ring; 21—annular flexible sleeve; 22—spirally extending hollow interlayer; 31—flexible sliding pipe; 32—annular sleeving pipe; 33—protective sleeving pipe.

DETAILED DESCRIPTION

Technical solutions in the embodiments of the present disclosure will be clearly and completely described below in conjunction with the accompanying drawings in the embodiments of the present disclosure. Obviously, the described embodiments are only parts of the embodiments of the present disclosure, rather than all the embodiments. Based on the embodiments of the present disclosure, all other embodiments obtained by those of ordinary skill in the art without creative work shall fall within the protection scope of the present disclosure.

As shown in FIGS. 1-5, the present disclosure provides a first embodiment of a kid play tunnel with an adjustable diameter during folding. The kid play tunnel comprises an elastic frame 1, a flexible tube coat 2, and sliding pipes 3. The elastic frame 1 is in a spiral shape. The elastic frame 1 comprises head sections respectively arranged on two ends of the elastic frame 1 and connecting sections connected with the head sections. Each head section of the elastic frame 1 overlaps a respective portion of a corresponding connecting section of the elastic frame 1 to form a frame ring 11. Each frame ring 11 is closed. Each frame ring 11 comprises a spiral end.

The flexible tube coat 2 is arranged on a whole section of the elastic frame 1. Two ends of the flexible tube coat 2 are annular flexible sleeves 21. Each annular flexible sleeve 21 is sleeved on a respective frame ring 11. Specifically, the elastic frame 1 further comprises a spiral section. A first end of each connecting section of the elastic frame 1 is connected with one end of a corresponding head section of the elastic frame 1. Two ends of the spiral section of the elastic frame 1 is separately connected with a second end of each connecting section of the elastic frame 1.

The sliding pipes 3 limit a circumferential sliding of the head sections of the elastic frame 1 with respect to the connecting section of the elastic frame to change a diameter of the frame rings 11.

Furthermore, the sliding pipes 3 are flexible sliding pipes 31. Optionally, the flexible sliding pipes 31 are made of transparent flexible plastic material. Each flexible sliding pipe 31 is arranged between a corresponding frame ring 11 and a corresponding annular flexible sleeve 21. An inner wall of each flexible sliding pipe 31 defines a sliding path of a corresponding head section of the elastic frame 1 and a corresponding connecting section of the elastic frame 1 when the corresponding head section of the elastic frame 1 and the corresponding connecting section of the elastic frame 1 slide relative to each other.

A cross section of the inner cavity of each flexible sliding pipe 31 is no less than a cross section of each frame ring 11. Optionally, the cross section of the inner cavity of the flexible sliding pipes 31 is greater than the cross section of the frame rings 11, so that the connecting sections of the elastic frame 1 slide smoothly in the sliding paths of the inner cavities of the flexible sliding pipes 31

After folding, the diameter of each frame ring 11 is reduced. An arc length of each flexible sliding pipe 31 is no more than a circumference of each frame ring 11 after folding. Before folding, the diameter of each frame ring 11 is not reduced, and the circumference of each frame ring 11 is greater than the arc length of each flexible sliding pipe 31. The flexible sliding pipes 31 are in an arc shape, and an arc length of an overlapping portion of each head section of the elastic frame 1 and the corresponding connecting section of the elastic frame 1 is no more than the arc length of each flexible sliding pipe 31. Each overlapping portion of the corresponding head section of the elastic frame 1 and the corresponding connecting section of the elastic frame 1 is arranged in a corresponding flexible sliding pipe 31, so the head sections of the elastic frame 1 are not easy to slip out of the flexible sliding pipes 31. Therefore, tips of the head sections of the elastic frame 1 would not pierce the annular flexible sleeves 21. After each frame ring 11 is compressed to a minimum diameter, two ends of each flexible sliding pipe 31 abut against each other to form a circular ring. A diameter of each circular ring is no more than a diameter of the kid play tunnel to be stored after folding In one optional embodiment, a spirally extending hollow interlayer 22 is arranged on an outer wall of the flexible tube coat 2. The spirally extending hollow interlayer 22 is sleeved on the spiral section of the elastic frame 1. The spirally extending hollow interlayer is communicated with the annular flexible sleeves 21. The flexible tube coat 2 reduces along with a compression of the elastic frame 1, and extends along with elastic reset of the elastic frame 1.

The kid play tunnel further comprises a flat storage belt 4. The flat storage belt is closed. A circumference of the flat storage belt 4 is two times of the diameter of each frame ring 11 after folding. The flat storage belt 4 is configured to bind the compressed elastic frame 1 to prevent resetting of the elastic frame 1.

The present disclosure further provides a storage method of a kid play tunnel. The storage method is applied to the kid play tunnel described above. The kid play tunnel comprises the elastic frame 1, the flexible tube coat 2, and the flexible sliding pipes 31. The elastic frame 1 is in the spiral shape. The elastic frame 1 comprises the head sections respectively arranged on the two ends of the elastic frame 1 and the connecting sections connected with the head sections. Each head section of the elastic frame 1 overlaps the respective portion of the corresponding connecting section of the elastic frame 1 to form one frame ring 11. Each frame ring 11 is closed. Each frame ring 11 comprises the spiral end. The flexible tube coat 2 is arranged on the whole section of the elastic frame 1. The two ends of the flexible tube coat 2 are annular flexible sleeves 21. Each annular flexible sleeve 11 is sleeved on the respective frame ring 11. The flexible sliding pipes 31 limit the circumferential sliding of the head sections of the elastic frame 1 with respect to the connecting section of the elastic frame 1. The diameter of each frame ring 11 is reduced by the corresponding flexible sliding pipes when the kid play tunnel is folded. The kid play tunnel further comprises the flat storage belt 4. The flat storage belt 4 is closed. The circumference of the flat storage belt 4 is two times of the diameter of each frame ring 11 after folding The storage method comprises steps:

S1: controlling the head sections of the elastic frame and the connecting sections of the elastic frame to slide along the inner walls of the sliding pipes in a circumferential direction to reduce the diameter of the frame rings to the minimum;

S2: reducing the diameter of a whole section of the elastic frame to a same diameter as a minimum diameter of the frame rings;

S3: fixing the kid play tunnel by the flat storage belt arranged on the elastic frame; and S4: putting the kid play tunnel into a packaging bag to complete packaging.

Figure 6:
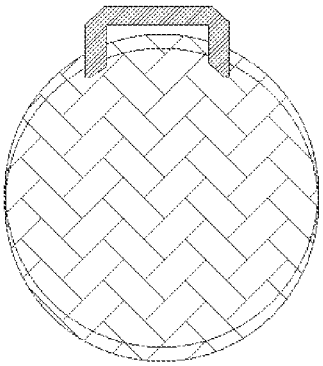
FIG. 6 is a schematic diagram of the kid plat tunnel according to the first embodiment of the present disclosure where the kid play tunnel is packaged and received in a packaging bag.
Figure 7:
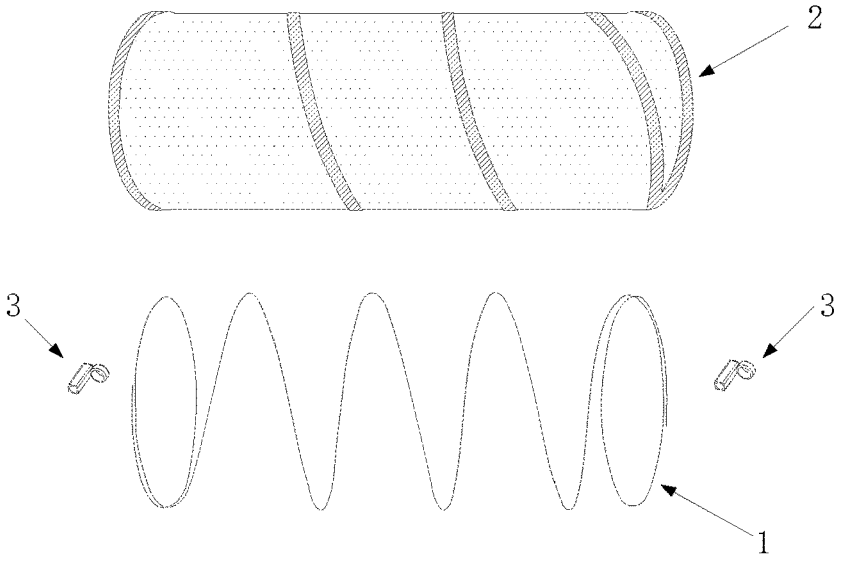
FIG. 7 is an exploded schematic diagram of the kid plat tunnel according to a second embodiment of the present disclosure.
Figure 8:
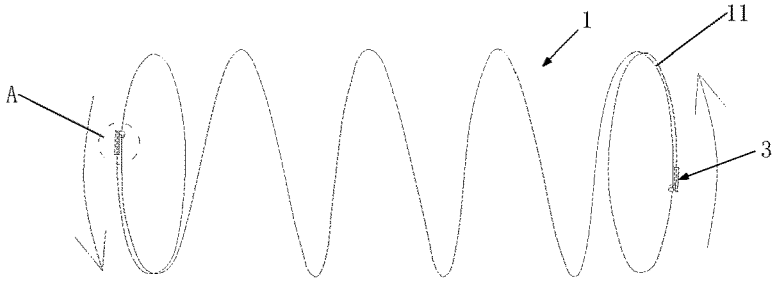
FIG. 8 is a schematic diagram of the elastic frame according to the second embodiment of the present disclosure where the elastic frame is in a state before radial compressed.
Figure 9:
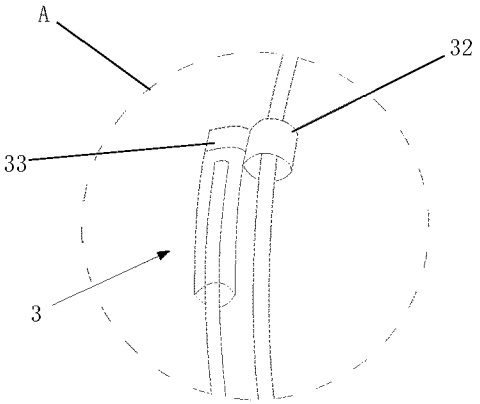
FIG. 9 is an enlarged schematic diagram of portion A shown in FIG. 8.
Figure 10:
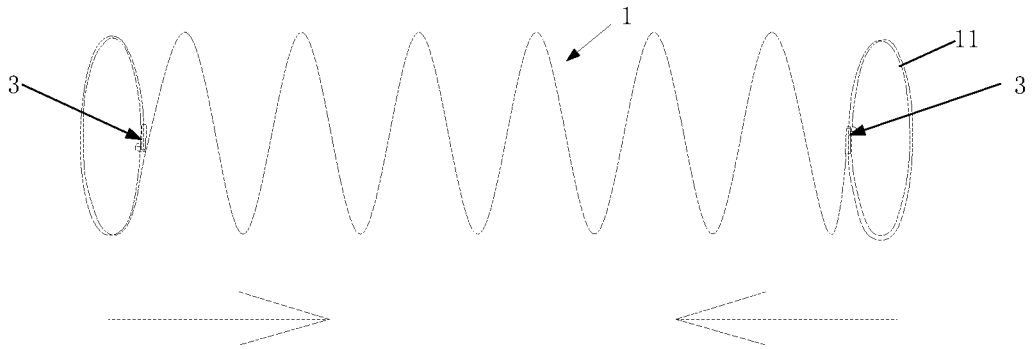
FIG. 10 is a schematic diagram of the elastic frame according to the second embodiment of the present disclosure where the elastic frame is radial compresses.

As shown in FIG. 6, the fixed folded kid play tunnel is put into the packaging bag. When the kid play tunnel is to be used, the kid play tunnel is taken out and the flat storage belt is released, then the kid play tunnel automatically unfolded.

A wording principle of the technical solution is as follows: as shown in FIGS. 1-5, when folding the kid play tunnel, a user holds and fixes one of the flexible sliding pipes 31 arranged on a first end of the elastic frame 1 with one hand, and the other hand rotates the corresponding connecting section of the elastic frame 1 clockwise relative to the corresponding flexible sliding pipe 31. The corresponding connecting section of the elastic frame 1 slides along the inner wall of the flexible sliding pipe, and an outer diameter of the frame ring 11 gradually reduced in the radial direction until the two ends of the flexible sliding pipe 31 abut against each other to form the circular ring. The diameter of the circular ring is a diameter suitable for the packaging of the packaging bag. At the same time, another user holds and fixes the other one of the flexible sliding pipes 31 arranged on a second end of the elastic frame 1 with one hand, and the other hand rotates the corresponding connecting section of the elastic frame 1 clockwise relative to the corresponding flexible sliding pipe 31. The corresponding connecting section of the elastic frame 1 slides along the inner wall of the flexible sliding pipe, and the outer diameter of the frame ring 11 gradually reduced in the radial direction until the two ends of the flexible sliding pipe 31 abut against each other to form the circular ring.

The two users operate synchronously to compress the frame rings 11 at both ends of the elastic frame 1 and drive the elastic frame 1 to rotate and compressed as a whole. After an overall outer diameter of the elastic frame 1 reduces, the two users move toward each other to compress the elastic frame 1 along an axial direction (length direction) to the minimum. Then the flat storage belt 4 is used to bind the compressed elastic frame 1 to prevent resetting.

The kid play tunnel with the adjustable diameter during folding provided by the present disclosure has a simple structure and is convenient to operate. After folding, the volume of the kid play tunnel is greatly reduced, which is convenient for transportation, reduces logistics costs, and thus saves cost.

As shown in FIGS. 7-10, the present disclosure provides a second embodiment of the kid play tunnel with the adjustable diameter during folding. The kid play tunnel comprises the elastic frame 1, the flexible tube coat 2, and the sliding pipes 3. Most of structures of the kid play tunnel of the second embodiment are same as that of the first embodiment, except that a structure of the sliding pipes 3 is different.

In the embodiment, the sliding pipes 3 are annular sleeving pipes 32. A protective sleeving pipe 33 is arranged on one side of each annular sleeving pipe 32. Each protective sleeving pipe 33 is sleeved on a corresponding head section of the elastic frame 1. Each connecting section of the elastic frame 1 slides along an inner wall of a corresponding annular sleeving pipe 32 to reduce the diameter of a corresponding frame ring 11. Each annular sleeving pipe 32 and the corresponding protective sleeving pipe 33 are integrally formed.

Each annular sleeving pipe 32 is configured to define the sliding path of the corresponding connecting section of the elastic frame 1 that slides along the inner wall of each annular sleeving pipe 32. The sliding path defined by each annular sleeving pipe is less than the sliding path defined by each flexible sliding pipe in the first embodiment. The protective sleeving pipes 33 are configured to completely cover the head sections of the elastic frame 1 to prevent the tips of the head sections of the elastic frame 1 from piercing the annular flexible sleeves 21

In the kid play tunnel of the second embodiment, each sliding pipe are integrally formed and each sling pipe comprises the annular sleeving pipe and the protective sleeving pipe. Each protective sleeving pipe is wrapped on the corresponding head section of the elastic frame. A length of each connecting section of the elastic frame slides along the inner wall of the corresponding annular sleeving pipes is greatly reduced, which is convenient to slide when folds the lid play tunnel. After folding, the volume of the kid play tunnel to be stored is greatly reduced, which is convenient for transportation, reduces logistics costs, and thus saves cost.

Although optional embodiments of the present disclosure have been described, those skilled in the art are able to make additional changes and modifications to these embodiments once they learn the basic creative concept. Therefore, the attached claims are intended to be interpreted as including the optional embodiments and all changes and modifications falling within the scope of the present disclosure.

Obviously, those skilled in the art are able to make various changes and modifications to the embodiments of the present disclosure without departing from the spirit and scope of the embodiments of the present disclosure. In this way, if these changes and modifications of the embodiments of the present disclosure fall within the scope of the claims of the present disclosure and their equivalent technologies, the present disclosure is also intended to include these modifications and variations.

What is claimed is:

1. A kid play tunnel, comprising: an elastic frame, a flexible tube coat, and sliding pipes; wherein the elastic frame is in a spiral shape; the elastic frame comprises head sections respectively arranged on two ends of the elastic frame and connecting sections connected with the head sections; each head section of the elastic frame overlaps a respective portion of a corresponding connecting section of the elastic frame to form a frame ring; each frame ring is closed; each frame ring comprises a spiral end;

the flexible tube coat is arranged on a whole section of the elastic frame; two ends of the flexible tube coat are annular flexible sleeves; each annular flexible sleeve is sleeved on a respective frame ring;

wherein the sliding pipes limit a circumferential sliding of the head sections of the elastic frame with respect to the connecting section of the elastic frame; a diameter of each frame ring is reduced by a corresponding sliding pipe when the kid play tunnel is folded;

wherein a spirally extending hollow interlayer is arranged on an outer wall of the flexible tube coat the spirally extending hollow interlayer is sleeved on the spiral section of the elastic frame; the spirally extending hollow interlayer is communicated with the annular flexible sleeves.

2. The kid play tunnel according to claim 1, wherein the sliding pipes are flexible sliding pipes; each flexible sliding pipe is arranged between a corresponding frame ring and a corresponding annular flexible sleeve; an inner wall of each flexible sliding pipe defines a sliding path of a corresponding head section of the elastic frame and a corresponding connecting section of the elastic frame when the corresponding head section of the elastic frame and the corresponding connecting section of the elastic frame slide relative to each other.

3. The kid play tunnel according to claim 2, wherein after folding, the diameter of each frame ring is reduced to the minimum; an arc length of each flexible sliding pipe is no more than a circumference of each frame ring after folding.

4. The kid play tunnel according to claim 3, wherein a cross section of an inner cavity of each flexible sliding pipe is no less than a cross section of each frame ring.

5. The kid play tunnel according to claim 3, wherein two ends of each flexible sliding pipe abut against each other to form a circular ring; a diameter of each circular ring is no more than a diameter of the kid play tunnel after folding.

6. The kid play tunnel according to claim 2, wherein the elastic frame further comprises a spiral section, a first end of each connecting section of the elastic frame is connected with one end of a corresponding head section of the elastic frame; two ends of the spiral section of the elastic frame is separately connected with a second end of each connecting section of the elastic frame.

7. The kid play tunnel according to claim 1, wherein the kid play tunnel further comprises a flat storage belt; the flat storage belt is closed; a circumference of the flat storage belt is two times of the diameter of each frame ring after folding.

8. A storage method of a kid play tunnel, comprising steps:

controlling head sections of an elastic frame and connecting sections of the elastic frame to slide along inner walls of sliding pipes in a circumferential direction to reduce a diameter of the frame rings to a minimum diameter;

reducing a diameter of a whole section of the elastic frame to a same diameter as a minimum diameter of the frame rings;

fixing the kid play tunnel by a flat storage belt arranged on the elastic frame; and putting the kid play tunnel into a packaging bag to complete packaging;

wherein the kid play tunnel comprises the elastic frame, a flexible tube coat, and the sliding pipes; wherein the elastic frame is in a spiral shape; the elastic frame comprises the head sections respectively arranged on two ends of the elastic frame and the connecting sections connected with the head sections; each head section of the elastic frame overlaps a respective portion of a corresponding connecting section of the elastic frame to form one frame ring; each frame ring is closed; each frame ring comprises a spiral end; the flexible tube coat is arranged on a whole section of the elastic frame; two ends of the flexible tube coat are annular flexible sleeves; each annular flexible sleeve is sleeved on a respective frame ring; the sliding pipes limit a circumferential sliding of the head sections of the elastic frame with respect to the connecting section of the elastic frame; a diameter of each frame ring is reduced by a corresponding sliding pipe when the kid play tunnel is folded; the kid play tunnel further comprises the flat storage belt; the flat storage belt is closed; a circumference of the flat storage belt is two times of the diameter of each frame ring after folding wherein a spirally extending hollow interlayer is arranged on an outer wall of the flexible tube coat; the spirally extending hollow interlayer is sleeved on the spiral section of the elastic frame; the spirally extending hollow interlayer is communicated with the annular flexible sleeves.

9. A kid play tunnel, comprising: an elastic frame, a flexible tube coat, and sliding pipes; wherein the elastic frame is in a spiral shape; the elastic frame comprises head sections respectively arranged on two ends of the elastic frame and connecting sections connected with the head sections; each head section of the elastic frame overlaps a respective portion of a corresponding connecting section of the elastic frame to form a frame ring; each frame ring is closed; each frame ring comprises a spiral end;

the flexible tube coat is arranged on a whole section of the elastic frame; two ends of the flexible tube coat are annular flexible sleeves; each annular flexible sleeve is sleeved on a respective frame ring;

wherein the sliding pipes limit a circumferential sliding of the head sections of the elastic frame with respect to the connecting section of the elastic frame; a diameter of each frame ring is reduced by a corresponding sliding pipe when the kid play tunnel is folded;

wherein the sliding pipes are annular sleeving pipes; a protective sleeving pipe is arranged on one side of each annular sleeving pipe; each protective sleeving pipe is sleeved on a corresponding head section of the elastic frame; each connecting section of the elastic frame slides along an inner wall of a corresponding annular sleeving pipe to reduce the diameter of a corresponding frame ring.

* * * * *